US005422864A

United States Patent [19]

Lorello

[11] Patent Number: 5,422,864

[45] Date of Patent: Jun. 6, 1995

[54] MINUTE CLOCKS

[75] Inventor: James Lorello, 17 Park Rd., Ivoryton, Conn. 06442

[73] Assignee: James Lorello, Ivoryton, Conn.

[21] Appl. No.: 670,493

[22] Filed: Mar. 15, 1991

Related U.S. Application Data

[63] Continuation of Ser. No. 408,075, Sep. 15, 1989, abandoned.

[51] Int. Cl.[6] ..... G04B 19/04

[52] U.S. Cl. ..... 368/223; 368/228; 368/71; 368/80

[58] Field of Search ..... 368/223–239, 368/76–84, 71

[56] References Cited

U.S. PATENT DOCUMENTS

| | | | |
|---|---|---|---|
| 903,964 | 11/1908 | Ferguson | 368/232 |
| 908,786 | 1/1909 | Longtime | 368/232 |
| 1,476,749 | 12/1923 | Yeomans | 368/228 |
| 1,807,497 | 5/1931 | Speciale | 368/228 |
| 1,851,824 | 3/1932 | Fewell | 368/228 |
| 1,990,730 | 9/1916 | Borresen | 368/228 |
| 4,271,497 | 6/1981 | Terzian | 368/239 |
| 4,885,731 | 12/1989 | Massaro | 368/282 |

*Primary Examiner*—Bernard Roskoski
*Attorney, Agent, or Firm*—Gene Winter; St. Onge, Steward, Johnson and Reens

[57] ABSTRACT

An analog timepiece that has a dominating large minute area surrounding a smaller hour inner circle area. The minute outer band area is divided into 2 hemispheres: the right hemisphere starting at the "o'clock" word on top, swing downward "after" around to the "half-past" word and arrow mark below, swinging upward "to or of" to the same "o'clock" word—thus completing the 60 minute band circle. Each of the two hemispheres will be a different but compatible color or shading from the other. The minute numbers in the one hemisphere will be the same size and type as the numbers in the other hemisphere, but of a different compatible color or shading (as blue and green, dark green and light green). The numbers in each hemisphere will begin next to "o'clock" and arrow with the number 5 appearing first in both hemispheres. Then using the multiples of 5, the numbers 5,10,15,20,25,30 will follow appropriately in both hemispheres with the number 30 shared at the bottom by both hemispheres. Some advanced analog timepieces will have a dual digital superimposed on it somewhere, showing the time after the hour in digitals and the time to the next hour also in digitals.

8 Claims, 1 Drawing Sheet

The MINUTE CLOCK - composite face - color coded

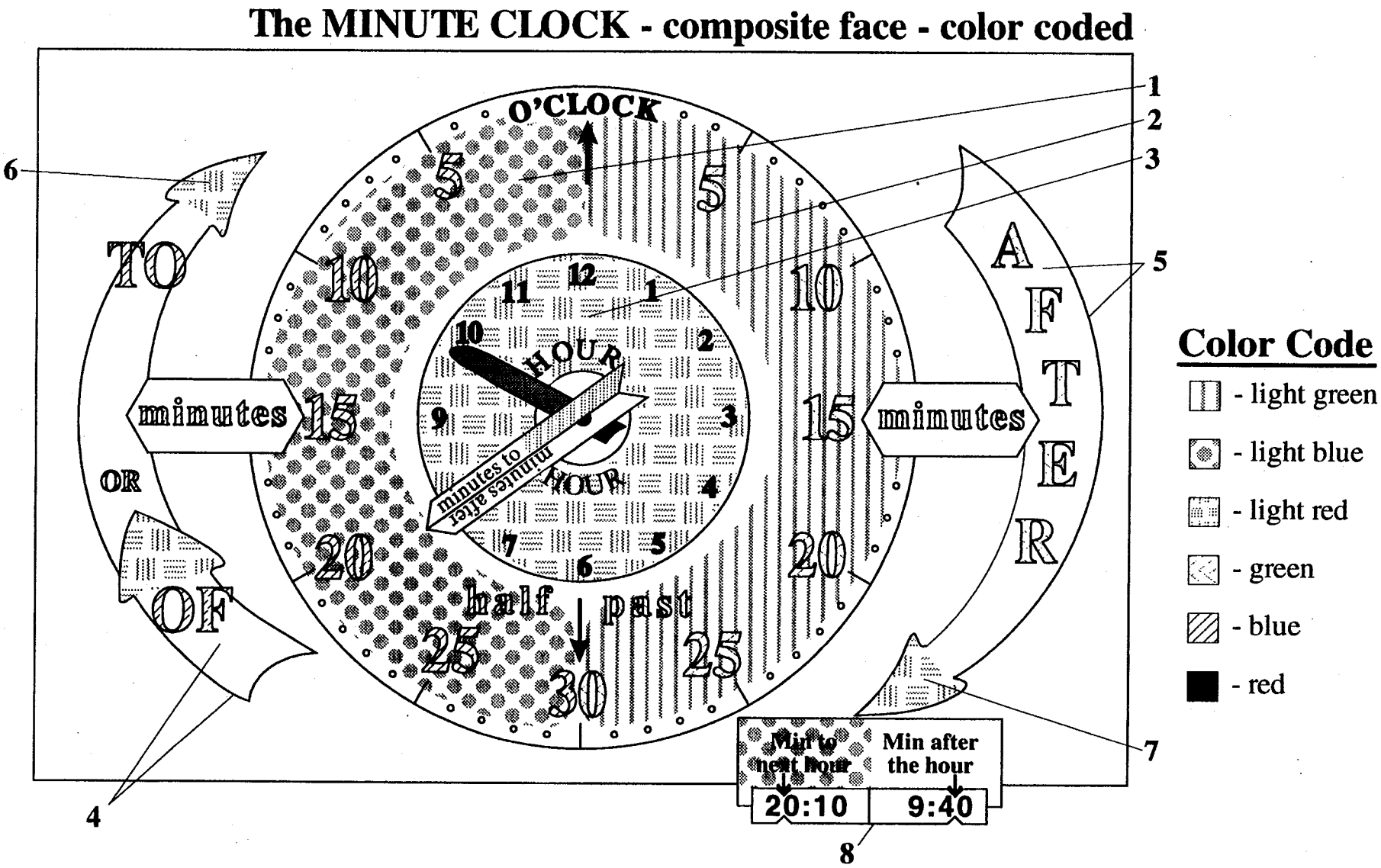
The MINUTE CLOCK - composite face - color coded
Color Code
- light green
- light blue
- light red
- green
- blue
- red
AFTER
minutes
O'CLOCK
TO
OR
OF
minutes
HOUR
minutes after
HOUR
minutes to
half
past
Min to next hour
20:10
Min after the hour
9:40
1
2
3
4
5
6
7
8

MINUTE CLOCKS

This is a continuation of application Ser. No. 07/408,075, filed on Sep. 15, 1989, now abandoned.

BACKGROUND OF THE INVENTION

The Analog Hour Clock was designed hundreds of years ago by and for professors and scholars of astronomy. Thus they were able to record the "rising and setting" of the sun, and its directional variations throughout the year. A few hundred years later the clock was introduced into the homes and into the school curriculum. But its face had been slightly modified, if any. The fact that the clock still needed a bit of college math extrapolation to arrive mentally at the correct time did not deter educators from fostering the "complicated" timepiece on children. The problem is that the Hour Clock shows the correct time only thrice: on the hour, on the half-past, and 10 minutes to the next hour. This makes the Hour Clock's display of telling time 90.5% inaccurate. So a child must rely on and trust his teacher (or parent) to show him, or tell him the correct time which the Hour Clock is not showing. The frustrated child can only learn by rote, memorize each position of the minute and hour hands as dictated by his teacher (or parent). Thus, not being able to tell the correct time independently on the Hour Clock, is an undetected problem that children develop into frustration early in life, and has never been seriously addressed by teachers, parents, or clock companies.

The digital of today is a series of changing numbers. Each number change is "frozen" in place for the length of time it is current. The hour number is visible for one hour, never moving until it abruptly changes to the next hour number. The minute number is visible for one minute, never moving until it too changes to the next minute number. It shows the viewer a set of numbers for that segment of time . . . nothing more . . . no evidence of the past, no anticipation for the future. Most adults can use the digital effectively because their body clocks adapt to the time it is, and they use the digital to confirm what time they think it is. That is, the viewer learns by repeated experiences and mentally gauges the time that has lapsed or is needed to reach the next minute or next hour. The viewer intuitively develops "time-spacing" rather than by the help of the digital.

For children, not showing the measurement of time from or to the hour or minute is a deficiency of the digital. As an example: it is easier to gauge the time left to the next hour when a child sees "20 minutes to 10" on an analog clock than to see 9:40 on a digital. To a child 9:40 on the digital gives no visual indication if that time is close of very far from the next hour, 10:00. A child will think the time is close to 10 because the number nine (9) is close to the number ten (10).

Neither the Analog Hour Clock nor the digital of today is a satisfactory timepiece. The Analog Hour Clock is an adult clock by design and will continue to baffle children, and some adults, by its "college" design. The digital does show precise hour and minute numbers, but fails as a true timepiece because it lacks vital hour and minute-space information. Thus the need for a New Clock.

DESCRIPTIONS OF PRIOR ARTS

In 1908 L. B. Ferguson received U.S. Pat. No. 903,964. He enlarged the minute numbers from 1 to 60 in increments of fives. The numbers were much larger than the hour numbers. Ferguson wrote that having extra large and noticeable minute numbers would "be of vital importance to railroad employees". It was and still is a high safety priority for trains to be at a certain place on the exact minute, and for engineers, conductors, trackswitchers, etc. to be aware of the train's exact location. So every railroad man had to read his watch correctly to the minute.

However, Mr. Ferguson's design falls short of being a reasonable improvement for analog clock readers because his large minute numbers can only be read digitally. Secondly, the hour numbers are so small that they appear "lost" even under the imposing hour and minute hands that are constantly sweeping over them.

So Ferguson's railroad clock would not be a good analog TELLING TIME tool in an average home or school. How can a parent or teacher teach the "o'-clock" or the "half-past" when they are missing? How can one teach "after" the hour with subservient hour numbers and "minutes to or of" the next hour with digital minute numbers?

R. V. Longtine received U.S. Pat. No. 908,786 in 1909. He introduced a dual-purpose one-hand clock. Though ingenious, the bold concept does not support nor improve the standard analog clock design. Longtine's clock design fails because the one-hand idea does not transcribe visual pictures of approximate angles of different minute-hour positions. This can only be done by using two clock hands on a standard analog clock.

B. A. Terjian's 1978 U.S. Pat. No. 4,271,497 "analog-type" digital design may be considered an improvement over the standard digital which shows just the 60 minute passage of time after each hour. His design uses the "two-hemisphere" reading of time—one hemisphere reading showing at one time while the other is blank. That is: the increasing of minutes from 00(o'clock) to the 30 minutes (half-past) is seen together with the existing hour number in a rectangular box on the right. Then there is a sudden switch to the left side of the same rectangular box on which the 29 minutes reduction to the next hour is exposed. This "after" and "before" sequence is repeated every hour for the twelve hour cycle, etc.

One serious flaw this "after" and "before" Terjian digital display has is that when the digital, as an example, shows 9:14, elementary grade children cannot mentally tally the number of minutes that are left to reach the next hour (10:00), that is, 46 minutes. The children's mental ability, being, as yet, undeveloped fully, may be only from one hour to the next. So their judgement of the passage of minutes could be warped—being either too long or too short. The sudden switch to the other side of the Terjian box (minutes before the next hour) may be too late.

The improvement of the digital I recommend is to have the exposure of both hemisphere readings energized all the time, and each box colored slightly different in compatible colors. Both readings seen at the same time will allow the reader the extra dividend of having all the information available every minute of every hour. Also, critical phrases such as: "the time is either . . . " "minutes to or of" "minutes after" must not be lacking.

OBJECTIVES AND ADVANTAGES OF THE MINUTE CLOCK

An important objective of the Minute Clock is to present an accurate picture of the analog time in "minutes after" and "minutes to" the hour. This improvement over the Hour Clock's presentation is especially necessary for children in their formative years, and a small percentage of adults who are mentally slow in grasping math skills in telling time. Specifically, it is an improved model of what the analog hour clock fails to do because its 60 minute exposure cycle is 90.5% "inaccurate".

Because the Minute Clock shows 100% of the correct minute numbers, and because the Minute Clock has the necessary guide words, "minutes after" "minutes to", arrows, etc., it will be easier to learn the minute-hour segments in the sequence of analog time. Color-coding of the minute numbers, the hour numbers, the two hemisphere areas, the arrows, etc., facilitates even more the telling of time process. Finally, the Minute Clock with all its improvements will eliminate the need to memorize each segment of telling time, as has to be done on the analog hour clock. It should also reduce the need for daily lesson plans in grade school, and allow a smooth transition to understanding and telling time on the analog hour clock.

BRIEF DESCRIPTION OF DRAWING

The drawing is a composite of the Minute Clock featuring all of the essential numbers, words, directional arrows, hour circle, dual hemispheres, lines, hands, digital components . . . all in proper, suggestive color schemes.

DESCRIPTION OF PREFERRED EMBODIMENT

The drawing of the composite face of the Minute Clock shows all the important features of the preferred embodiment.

The combined outer dual hemispheres, references 1 and 2 on drawing, containing the minute numbers, are the largest in area. The minute numbers in those two hemispheres are the largest. Each hemisphere area and its minute numbers within are the same color. But the area (background) of the hemisphere is usually a lighter shade than the numbers within. The two hemispheres are different in color but close in shade as blue-green, or brown-tan. So are the minute numbers in each hemisphere companion colors. Companion(close) colors are used in the hemispheres and their minute numbers so as not to break the circular allusion of the clock face.

The hour circle area, reference no. 3 on drawing, is about 4 times smaller than the two hemispheres which makes it subordinate in the sequence of telling analog time, to the larger minute area. It is the same color as the hour numbers within, but usually much lighter (rather than darker). The color of the hour numbers should be contrasted that is, very different from the minute numbers in either hemisphere. The word "o'clock" (always associated with the hour) is the color of the hour numbers. The compound word "half-past" is at the bottom in both minute hemispheres, and assumes the color of the numbers in which the part of the word is.

"TO or OF", the word "minutes", and the border around the arrow area on the left hemisphere side, are colored as the minute numbers in the left hemisphere. The arrow area, reference no. 4 on drawing, usually is colored as the left hemisphere area. The words "AFTER", "minutes", and the border around the arrow on the right hemisphere side are colored as the minute numbers in the right hemisphere. The arrow area, reference no. 5 on drawing, usually is colored as the right hemisphere area. The area of the points, reference nos. 6 and 7 on drawing, are usually shaded as the hour-circle area to lead the eyes and mind of the observer to the hour-circle area and hour number that the hour hand is pointing to.

The hour hand is the same color as the hour numbers.

The minute hand is divided lengthwise, each half to serve its purpose: pointing to a minute number with the appropriate wording and coloring.

The Dual Digital, reference no. 8 on drawing, will usually be used on advanced grade model or independently. Coloring its words, numbers, or background according to the two hemisphere divisions of the Minute Clock it represents, may not always be necessary. Only the two hour numbers in the two different boxes may be the same color (usually red), to distinguish them from the minute numbers, which can be energized light.

The Minute Clock's facial details, color coded, are the vital part of this Analog Timepiece. It is the purpose of the new facial arrangement to easily lead the viewer to see and use the functions of the analog Minute Clock, thus grasp, understand, and say the analog time. Note, also, that the minute numbers and their areas (the two hemispheres) are purposely larger than the other hour numbers in their smaller circle. The reason is to lead the viewer to see the minute numbers and words, if any, first. This is the proper and still the popular time-sequence beginning of the analog method of telling time. And to help in the time-sequence . . . the minute numbers in the in the right hemisphere, the words, and arrow outline in that area are the same color (green). The hemisphere area is light green. The minute numbers in the left hemisphere, the words, and arrow outline in that area are the same color (blue). The hemisphere area is light blue. So, summing up, each hemisphere and its contents are a different but "companion" color from the other hemisphere and its contents. This serves two purposes:

1. It will show that 2 time changes are made every hour . . .
   a. "after" the hour for 30 minutes from o'clock to half-past (green),
   b. "to or of" the next hour from half-past to o'clock (blue),
2. The continuity of the passing of the whole hour (60 minutes) concept cannot be challenged or doubted if the color code is followed.

To urge the viewer to read the hour number after the minute number sequence, the two arrow tips, colored as the hour circle area, prods the viewer to go to the passing hour or the next hour number, depending on the time showing on the clock, and to which number the hour hand is pointing. Another way the Minute Clock design helps the viewer to read the hour number last (after the minute number) is that the hour numbers have been shrunken and kept in an inner subordinate circle. Thus the larger minute numbers are seen first. But the hour numbers are not so small as to be insignificant. They are still big enough to be of equal importance as the minute numbers for they must make a strong presentation when independently read without the minutes, at "o'clock" and "half-past" the hour. Exposure studies have shown that when using proper code-coloring, a 4:1 minute number/hour number ratio and area sizes of same ratio are about right.

Each of the two hands colored accordingly also helps the viewer in telling the correct time: the hour hand the color of the hour numbers the minute hand bisected lengthwise and colored the two colors of the two hemisphere minute numbers, or with appropriate words.

Besides, having words as "o'clock", "half-past", guide words as "minutes to", "minutes after", the Minute Clock could also have "quarter after", "quarter past", "quarter to", and "hour".

The Minute Clock could also have on the base of it, or elsewhere, a color-coded Dual Digital which will show how many minutes after the hour, and how many minutes to the next hour there is. Both displays will be continuous and at the same time.

I claim:

1. An analog timepiece for permitting a user to determine the hour and determine the minutes past the hour or the minutes until the subsequent hour, the timepiece comprising:

a face having mounted thereon an hour hand revolving through a 360° arc;

a minute hand revolving through said 360° arc every sixty minutes;

indicia on the timepiece face indicating the number of hours coordinated with the hour in coordination with movement of the hour hand through said arc;

indicia on the face of the timepiece numbered in increasing increments from zero to thirty minutes through one-half of the arc of the minute hand and thirty minutes through zero through the other half of the arc of the minute hand wherein the time is readable by determining the hour and by determining in the first half hour arc of the minute hand the minutes past the hour and in the other half of the arc of the minute hand the minutes until the next hour.

2. A timepiece according to claim 1 wherein the minute numbers are in multiples of fives.

3. A timepiece according to claim 2 wherein the size of the hour indicia are less than approximately one quarter the size of the minute numbers.

4. A timepiece according to claim 3 wherein a word having the meaning of after is placed around the outer area of the first half hour of the hemisphere.

5. A timepiece according to claim 4 wherein a word having the meaning of until is placed adjacent the other half hour hemisphere.

6. A timepiece according to claim 5 wherein the first hour hemisphere has the numbers five, ten, fifteen, twenty, twenty-five, and thirty, placed clockwise in the appropriate first half hour of the minute hemisphere and wherein the numbers five, ten, fifteen, twenty, twenty-five, and thirty, are placed in counterclockwise in the second half hour hemisphere.

7. A timepiece according to claim 6 wherein the numbers in the first half hour hemisphere are colored differently than the numbers in the second half hour hemisphere.

8. A timepiece according to claim 7 wherein a pair of digital readouts is placed on the clock face showing the minutes past the hour corresponding to the location of the minute hand, the second digital readout showing the minutes until the next hour.

* * * * *